US008683940B2

(12) United States Patent
Lee et al.

(10) Patent No.: US 8,683,940 B2
(45) Date of Patent: Apr. 1, 2014

(54) APPARATUS FOR COATING A PROFILE SURFACE, AND COATING METHOD THEREOF

(75) Inventors: Suk Ho Lee, Chungcheongbuk-do (KR); Eun Chun Jung, Daegu (KR)

(73) Assignee: LG Chem, Ltd. (KR)

( * ) Notice: Subject to any disclaimer, the term of this patent is extended or adjusted under 35 U.S.C. 154(b) by 1489 days.

(21) Appl. No.: 11/870,585

(22) Filed: Oct. 11, 2007

(65) Prior Publication Data

US 2008/0105200 A1 May 8, 2008

(30) Foreign Application Priority Data

Oct. 13, 2006 (KR) ..... 10-2006-0099817
Feb. 21, 2007 (KR) ..... 10-2007-0017551

(51) Int. Cl.

| | |
|---|---|
| ***B05B 7/00*** | (2006.01) |
| ***B05C 11/00*** | (2006.01) |
| ***B05C 15/00*** | (2006.01) |
| ***B05C 1/00*** | (2006.01) |

(52) U.S. Cl.
USPC ..... 118/300; 118/75; 118/223; 118/641; 118/602

(58) Field of Classification Search
USPC ..... 118/75, 223, 300, 641, 602; 427/532
See application file for complete search history.

(56) References Cited

U.S. PATENT DOCUMENTS

| | | | | | |
|---|---|---|---|---|---|
| 3,004,875 | A * | 10/1961 | Lytle | 427/110 |
| 3,616,742 | A * | 11/1971 | Boyle | 118/224 |
| 3,693,585 | A * | 9/1972 | Reeve et al. | 118/104 |
| 4,241,646 | A * | 12/1980 | Tsuruta et al. | 454/52 |
| 5,460,120 | A * | 10/1995 | Paul et al. | 118/264 |
| 5,670,211 | A * | 9/1997 | Huber et al. | 427/244 |
| 6,027,566 | A * | 2/2000 | Telchuk et al. | 118/326 |
| 6,110,281 | A * | 8/2000 | Nelson et al. | 118/203 |
| 6,287,383 | B1 * | 9/2001 | Biro et al. | 118/307 |
| 6,521,044 | B1 * | 2/2003 | Obermark | 118/227 |
| 2004/0187774 | A1 * | 9/2004 | Guiduzzi et al. | 118/302 |
| 2005/0129866 | A1 * | 6/2005 | Chun-Shien | 427/427.1 |

* cited by examiner

*Primary Examiner* — Dah-Wei Yuan
*Assistant Examiner* — Binu Thomas
(74) *Attorney, Agent, or Firm* — Cantor Colburn LLP

(57) ABSTRACT

The present invention relates to an apparatus for coating a profile surface with metallic texture paint by roll coating in combination with spray coating, and a method for coating thereof. The first major feature of the present invention is an apparatus for coating a profile surface, characterized in that it is provided with a roll coater for roll coating at least one surface of profile with a UV paint served as a binder, and a spray coater, installed at a position next to the roll coater, for spray coating with a metallic texture paint comprising a solvent, acrylic beads and metal powders on the coating layer of UV paint. The second major feature of the present invention is a method for coating a profile comprising the steps of roll coating at least one surface of profile with a UV paint served as a binder, and spray coating with a metallic texture paint containing a solvent, acrylic beads and metal powders on the coating layer of UV paint.

10 Claims, 5 Drawing Sheets

View A

View B

APPARATUS FOR COATING A PROFILE SURFACE, AND COATING METHOD THEREOF

This application claims the benefit, of the filing date of Korean Patent Application No. 10-2006-0099817 filed on Oct. 13, 2006 and Korean Patent Application No. 10-2007-0017551 filed on Feb. 21, 2007 in the Korean Intellectual Property Office, the disclosure of which is incorporated herein in its entirety by reference.

TECHNICAL FIELD

The present invention relates to an apparatus for coating a profile surface with metallic texture paints by a roll coating in combination with a spray coating, and a method for coating thereof.

BACKGROUND ART

Generally, window materials of synthetic resins are prepared by extruding profiles, whose surfaces are almost color coated with white paints. Therefore, when windows are prepared from these materials and installed in buildings, the white exterior structures are displayed. Since these window materials have a single color, persons have generally feelings weaker than those of windows prepared by metal materials, when they view buildings outside. Therefore, aesthetic properties may be scarce, including surface texture and brightness. In addition, since paints have long curing times, curing works take much time and thus mass productivity is restricted.

Recently, when surfaces of three-dimensional products are applied, spray coating methods are mainly used. In addition, when surfaces of two-dimensional products are applied, roll coating methods are mainly used. However, no coating apparatus and coating method has been proposed, providing a metallic texture with surfaces of window materials by simultaneously using a spray coating method and a roll coating method.

DISCLOSURE OF THE INVENTION

Accordingly, the present invention is proposed to solve the conventional problem above. The major object of the present invention is to provide an apparatus for coating a profile surface that the surface of window materials (profile) is coated by simultaneously using a roll coating method and a spray coating method to have three-dimensional metallic texture.

The other object of the present invention is to provide a method for coating a profile surface using the coating apparatus.

To achieve the above objects, an apparatus for coating a profile surface, according to the present invention comprises a roll coater for roll coating at least one surface of the profile with a UV paint served as a binder; and a spray coater, installed at a position next to the roll coater, for spray coating with a metallic texture paint comprising a solvent, acrylic beads and metal powders on the coating layer of UV paint.

In the apparatus for coating the profile surface, the roll coater comprises a coating roll, rotatably installed above the profile, for roll coating with a UV paint injected from a paint injector on the profile; and a coating thickness adjustment roll, installed such that a space between the coating roll and the coating thickness adjustment roll may be adjusted on the surface of coating roll according to the adjusted space.

The apparatus for coating the profile surface according to the present invention can further comprise a first longitudinal transport means for adjusting a longitudinal gap between the coating thickness adjustment roll and the coating roll.

Also, the apparatus for coating the profile surface of the present invention further comprises a height adjustment means for adjusting heights the coating roll and the coating thickness adjustment roll.

Here, the surface of the coating roll is made of rubber or urethane, and at least surface of the coating thickness adjustment roll may be made of metal or high hard non-metal.

The apparatus for coating the profile surface according to the present invention further comprises a first paint receiver for receiving a UV paint flowing from both sides at a lower side of the profile, and a storage tank, positioned at the bottom of the first paint receiver, for storing UV paint recovered to the first paint receiver.

The apparatus for coating the profile surface of the present invention further comprises a recovery pump for allowing the UV paint in the storage tank to be introduced to the paint injector.

In the apparatus for coating the profile surface according to the present invention, a splash prevention means can be positioned right below the spray coater and can absorb the metallic texture paint sprayed from the spray coater for preventing the metallic texture paint to be splashed. Here, tray filled with water can be used as the splash prevention means.

The apparatus for coating the profile surface of the present invention may further comprise a scatter prevention means, installed below the spray coater, and absorbing the metallic texture paint sprayed from the spray coater for preventing the metallic texture paint to be scattered around.

In the apparatus for coating the profile surface according to the present invention, the scatter prevention means comprises a second paint receiver for receiving the scattered paint, and a discharge pump for sucking the paint in the second paint receiver and discharging it out of the second paint receiver.

In the apparatus for coating the profile surface according to the present invention, a filter for filtering paint can be installed between the second paint receiver and the discharge pump and a shield plate can be installed below the spray coater for preventing the non-coated side of the profile from being coated with the metallic texture paint.

In addition, the apparatus for coating the profile surface according to the present invention can further comprises a sensor installed at the introduction portion of the spray coater for sensing whether the profile is approached or not, a curing device installed behind the spray coater for curing the metallic texture paint with which the profile is coated and/or a take-off device, installed behind the curing device, for drawing out the completely coated profile.

On the other hand, a method for coating a profile according to the present invention comprises the steps of coating with a UV paint served as a binder on at least one surface of the profile, and coating with a metallic texture paint containing a mixture of a solvent, acrylic beads and metal powders on the UV paint coating layer.

Here, it is preferable that the step for coating the profile with the UV paint is performed by roll coating, and the step for coating the UV paint coating layer with the metallic texture paint is performed by spray coating.

BEST MODE FOR CARRYING OUT THE INVENTION

Preferred examples of the present invention are explained in detail below, with reference to the accompanying drawings.

Figure 1:
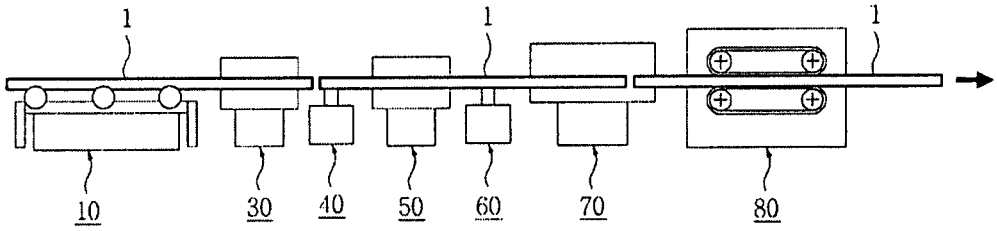
FIG. 1 is a view showing an entire structure of an apparatus for coating a profile, according to the present invention.
Figure 2:
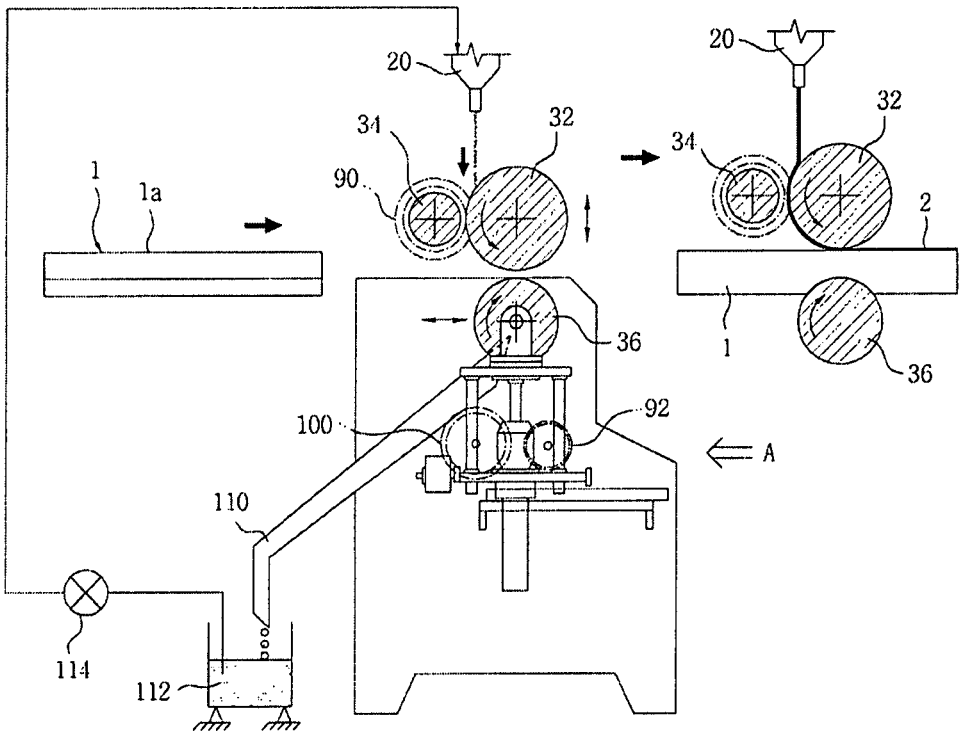
FIG. 2 is a detail view of a roll coater in the apparatus for coating a profile, according to the present invention.
Figure 3:
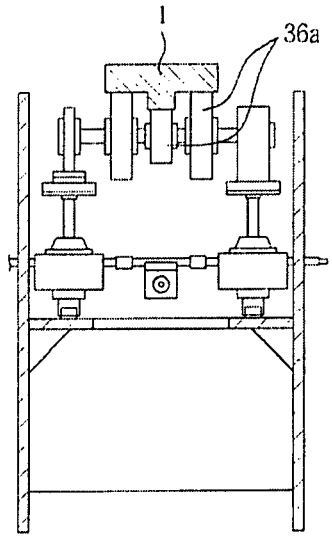
FIG. 3 is a view of a roll coater viewed from "A" in FIG. 2.
Figure 4:
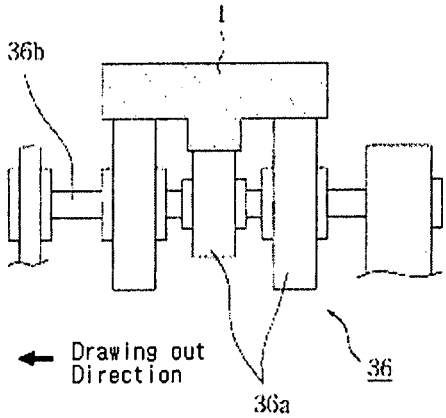
FIG. 4 is a view showing a structure of a back up roll in the apparatus for coating a profile, according to the present invention.
Figure 5:
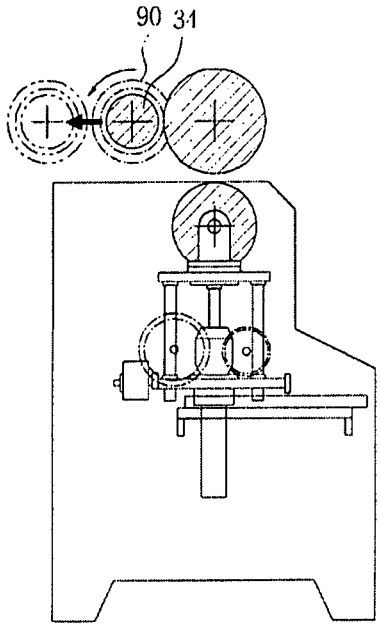
FIG. 5 is a view of showing a state where a control roll for coating thickness is longitudinally transported.
Figure 6:
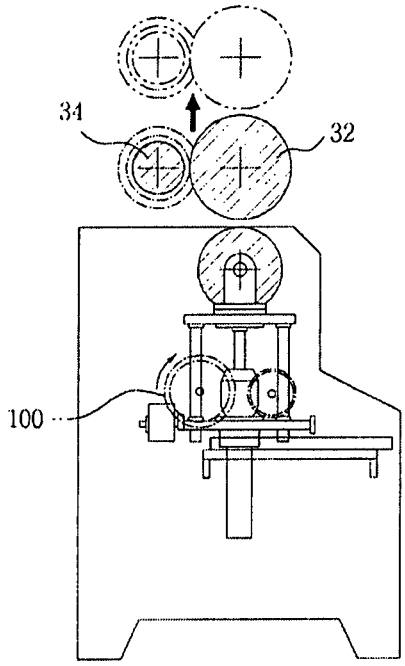
FIG. 6 is a view showing a state where height of a coating roll and a control roll for coating thickness is adjusted.
Figure 7:
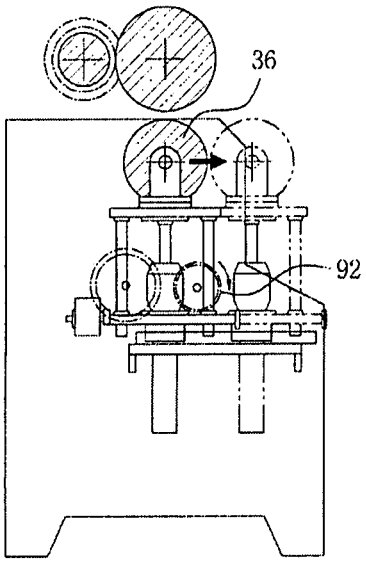
FIG. 7 is a view showing a state where a back-up roll is longitudinally transported.
Figure 8:
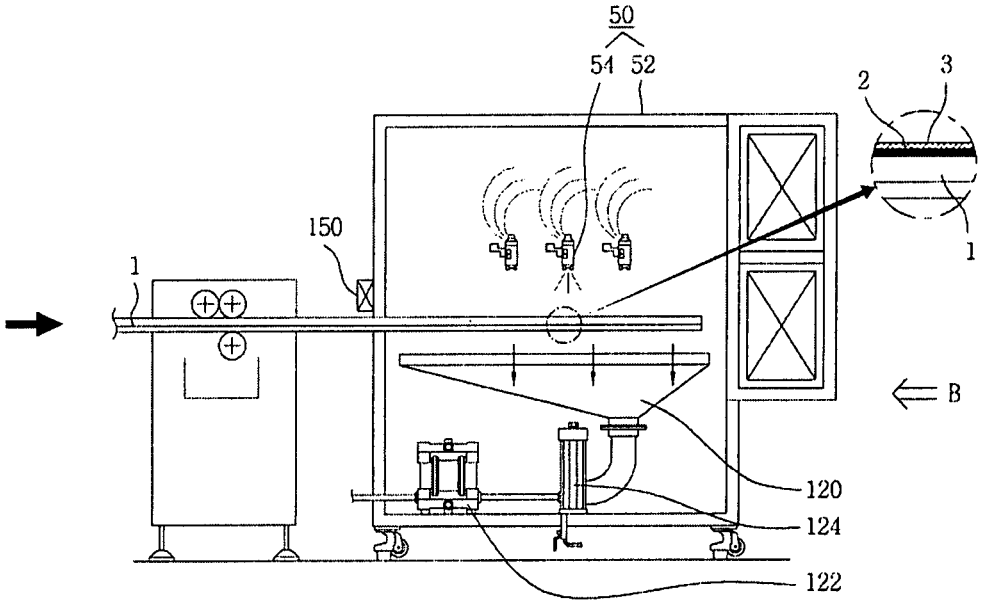
FIG. 8 is a detail view of a spray coater in the apparatus for coating a profile, according to the present invention.
Figure 9:
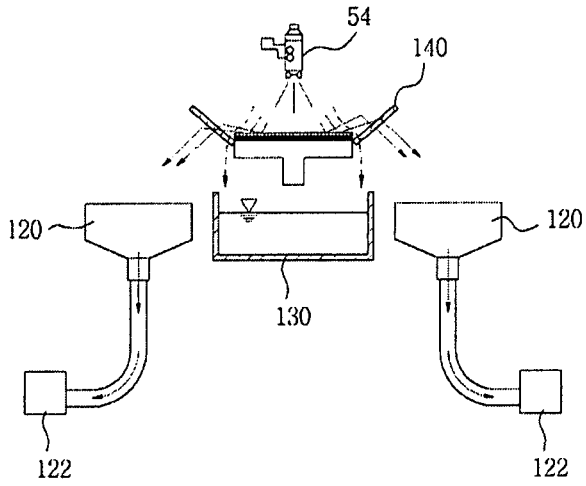
FIG. 9 is a view of a spray coater viewed from "B" in FIG. 8.
Figure 10:
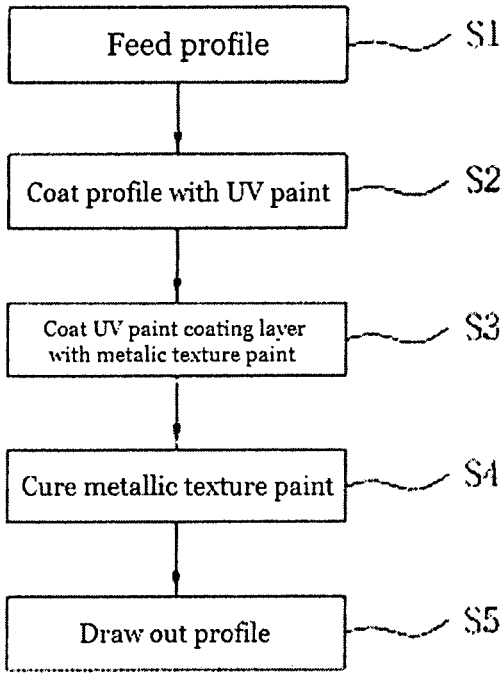
FIG. 10 is a flow chart for explaining the method for coating a profile, according to the present invention.

FIG. 1 is a view showing an entire structure of an apparatus for coating a profile, according to the present invention. FIG. 2 is a detail view of a roll coater in the apparatus for coating a profile, according to the present invention. FIG. 3 is a view of a roll coater viewed from "A" in FIG. 2. FIG. 4 is a view showing a structure of a back up roll in the apparatus for coating a profile, according to the present invention. FIG. 5 is a view of showing a state where a control roll for coating thickness is longitudinally transported. FIG. 6 is a view showing a state where height of a coating roll and a control roll for coating thickness is adjusted. FIG. 7 is a view showing a state where a back-up roll is longitudinally transported. FIG. 8 is a detail view of a spray coater in the apparatus for coating a profile, according to the present invention. FIG. 9 is a view of a spray coater viewed from "B" in FIG. 8. FIG. 10 is a now chart for explaining the method for coating a profile, according to the present invention.

The apparatus for coating a profile surface provided in the present invention, may afford the coated surface three-dimensional metallic texture by being simultaneously subjected to roll coating and spray coating on the outside surface of synthetic resin window materials (hereinafter, referred to as "profile,") prepared by extrusion. Detailed constitution is as follows:

As shown in FIG. 1, the coating apparatus comprises a material supplier 10 for automatically supplying a profile 1; a roll coater 30 positioned behind the material supplier 10 for forming a UV paint coating layer 2 on the target coating surface 1*a* of the profile 1 by roll coating the target coating surface of the profile 1 transported from the material supplier with a UV paint (served as a binder) injected from the paint injector 20; a first guide device 40, positioned behind the roll coater 30, for guiding the profile 1 transported from the roll coater to the next process; a spray coater 50, positioned behind the first guide device 40, for allowing to form a paint layer 3 with a metallic texture by spray coating with a metallic texture paint mixed with a solvent, acrylic beads and metal powders oil the UV paint coating layer 2; a second guide device 60, positioned behind the spray coater 50, for guiding the profile 1 transported from the spray coater to the next process; a curing device 70, installed behind the second guide device 60, for curing the paint layer 3 with a metallic texture passed through the second guide device; and a take-off device 80, installed behind the curing device 70, for drawing out the profile 1.

As shown in FIG. 2, the roll coater 30 above comprises a coating roll 32, rotatably installed above the profile 1, for covering on its circumferential surface with a UV paint injected from the paint injector 20 and then transferring the UV paint covered oil the circumferential surface to a target coating surface 1*a* for coating of the profile 1, with rolling the roll; and a coating thickness adjustment roll 34, parallel installed to have a gap adjustable with the coating roll 32, for adjusting a coating thickness so that the coating roll 32 may be covered with a paint injected from the paint injector 20 in a certain thickness.

At least surface of the coating roll 32 consists, preferably, of rubber or urethane as deformable materials, for strengthening adhesion to the target coating surface 1*a*. Preferably, non-deformable materials, such as metal or non-metal materials, especially high hard materials with less deformability, are also preferably applied to the coating thickness adjustment roll 34, rather than deformable materials, because the thickness of UV paint in the coating thickness adjustment roll has to be exactly adjusted.

As shown in FIG. 5, the coating thickness adjustment roll 34 may be movably installed in a horizontal direction far or near from the coating roll 32 by the first longitudinal movement means 90 to adjust a space between the coating roll 32 and the coating thickness adjustment roll 34. Therefore, the thickness of UV paint covered on the circumferential surface of coating roll 32 may be adjusted in a thick or thin thickness.

At this time, the first longitudinal movement means 90 is operated, for example, by a rotary handle.

In addition, a height of the coating roll 32 and the coating thickness adjustment roll 34 is adjusted by a height adjustment means 100, as shown in FIG. 6. Therefore, even if a profile 1 with different height is supplied, any coating work may be performed.

Here, the height adjustment means 100 is operated, for example, by a rotary handle.

Meanwhile, a support roll 36 for supporting roll-wise the bottom of the profile 1 is installed right below the coating roll 32. Then, to provide such compatibility that may support not only particular profiles but also other shaped profiles, the support roll 36 consists of several unit support rolls 36*a* with various diameters to be inserted in one axis 36*b* and thus if desired, may support bottoms of various shaped profiles by changing the arrangement of unit support rolls 36*a*, as shown in FIGS. 3 and 4.

Since each unit support roll 36*a* has to support the profile 1 without any impact, at least surfaces are, preferably, applied thereon with buffer materials such as rubber, soft plastics, or urethane, but central parts are not necessarily so.

The support roll 36 is capable of horizontally moving right downward or away from the coating roll 32 by a second longitudinal movement means 92, which is operated, for example, by a rotary handle.

As shown in FIG. 2, a first paint receiver 110 is installed at both sides of the support roll 36, to receive an excess of UV paint fallen from both sides of a profile 1 on coating with a UV paint. A storage tank 112 is installed below the first paint receiver 110, to storage UV paint discharged from the first paint receiver. Further, a recovery pump 114 is also installed to automatically feed UV paint in the storage tank 112 into the paint injector 20.

As shown in FIGS. 8 and 9, the spray coater 50 comprises a protecting cover 52 and one or more spray nozzles 54 installed within the protecting cover 52 following a moving route of the profile 1. Since the metallic texture paint is injected in a high pressure from the spray nozzle 54, it results in a problem of being scattered everywhere. Scattering of the metallic texture paint contaminates the inside of protecting cover 52. In addition, when scattering materials collide into other places and then splash on the profile 1, this is a factor of lowering the coating precision of profile. To solve this problem, a scatter prevention means is provided below both sides of the spray coater 50, for absorbing lest the metallic texture paint should be scattered, and a splash prevention means is provided for preventing from splashing the scattered metallic texture paint on a profile 1.

The scatter prevention means consists of a second paint receiver 120 being installed at both sides of the spray nozzle 54 to receive the paint scattered from the spray nozzle 54, and a discharge pump 122 for discharging the paint in the second paint receiver 120. Then, if the metallic paint is discharged via a sewer as such, the environment may be contaminated. Considering such environment contamination, a filter 124 for filtering paint component included in the metallic texture paint is, preferably, installed between the second paint receiver 120 and the discharge pump 122.

The splash prevention means comprises a tray 130 filled with water. Such water filled tray 130 may prevent from splashing the spattered metallic texture paint, of the metallic texture paint injected from the spray nozzle 54, on a profile 1 by directly absorbing it in water.

In addition, as shown in FIG. 9, a shield plate 140 is further installed at both sides of a passage, in which a profile 1 passes through the spray coater 50, below the spray coater, for preventing from spraying the metallic texture paint on non-coated side of the profile 1. Preferably, the shield plate 140 is installed to have an appropriate angle of incline, considering the spattering angle of the metallic texture paint.

Additionally, as shown in FIG. 8, a sensor 150 is further installed at the introduction part of the spray coater 50, for sensing the approach of a profile 1 to determine the operation of the spray nozzle 54. The sensor 150 senses whether or not a profile 1 approaches into the spray coater 50 and then transmits signals to control parts (not shown), playing a role in allowing the operation of the spray nozzle 54 to be automatically controlled. That is, the spray nozzle 54 is operated by the sensor 150 and the control parts, when the profile 1 approaches at the predetermined position, but not operated when the profile does not approach at the position. Therefore, unnecessary spraying of metallic texture paints may be prevented.

Finally, the curing device 70 is provided inside with an ultraviolet lamp and plays a role in curing the metallic texture paint on the profile 1 passing through it. The take-off device 80 is provided with several take-off rollers (not shown) for drawing out the profile 1. Preferably, an electric roller automatically rotated by a driving means is applied to the take-off roller. Therefore, the profile allows to be automatically drawn out, even though workers do not artificially draw out, so that the present apparatus may have high mass productivity.

The method for coating surface of profile using the present apparatus is as follows (see FIG. 10):

First Step: Step of Feeding Profile (S1)

In the step of feeding a profile, a profile 1 is automatically led by the material supplier 10. When the material supplier 10 is manually operated, workers feed profiles at an appropriate time, considering the coating speed of profiles. When the material supplier 10 is automatically operated, the moving speed of profiles 1 is sensed by a sensor, and the like, and then profiles are automatically led.

Second Step: UV Paint is Roll Coated on a Target Coating Surface of a Profile (S2).

In this process, UV paint injected between the coating roll 32 and the coating thickness adjustment roll 34 is covered on the coating roll 32, and then the covered UV paint on the coating roll 32 is transferred into the target coating surface 1*a* of the proceeding profile 1 via roll contact.

The UV paint is a binder served as an adhesive such that metallic texture paint to be explained in the following step can be well adhered to the profile 1. The UV paint is coated in as small quantities as may perform an adhesive function rather than in large quantities Third Step: Metallic Texture Paint is Spray Coated on the Target Coating Surface of Profile (S3).

The metallic texture paint mixed with a solvent, acrylic beads and metal powders is spray coated on the target coating surface 1*a* of profile 1 coated with UV paint in the previous step by spray coater. Since the metallic texture paint is coated by spray coater, with the metal powders evenly dispersed, the three-dimensional metallic texture which could not be represented by roll coating is displayed, and rough feeling of metal material surfaces may be expressed due to the dispersion of metal powders. If such coated profiles are utilized as window materials, the feeling of strong strength is rendered.

Here, the metal powders are suitably aluminum powders, considering luster or economics. The aluminum powders have suitably a particle size of 18 to 30 microns.

Fourth Step: Curing of Metallic Texture Paint (S4)

As the coated profile 1 with metallic texture paint passes through the curing device 70, the metallic texture paint is cured by ultraviolet irradiated from an ultraviolet lamp provided in the curing device.

Fifth Step: Drawing Out of the Completely Coated Profile (S5).

All the coating processes are ended by forcibly drawing out the completely coated and cured profile 1 via the take-off device 80. It is preferred in terms of mass productivity that take-off rollers in the take-off device 80 are rotated by the driving means, such that profile 1 may be automatically drawn out.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and appended claims. In addition to variations and modifications in the component parts and/or arrangements, alternative uses will also be apparent to those skilled in the art.

INDUSTRIAL APPLICABILITY

As explained above, the present invention may represent three-dimensional metal texture, despite synthetic resin, in color coating of profile surfaces, by coating with UV paint served as a binder, in a manner of roll coating, to form a substrate layer, and dispersedly applying metallic texture paint, in a manner of spray, on the substrate layer.

In addition, as UV paints with relatively short curing the are used instead of paints with long curing lime, the present invention does not need several curing processes under the process, and mass production may be allowed by only one curing process.

The invention claimed is:

1. An apparatus for coating a profile surface comprising:

a roll coater for roll coating at least one surface of the profile with a UV paint served as a binder; and a spray coater, installed at a position next to the roll coater, for spray coating with a metallic texture paint containing a solvent, acrylic beads and metal powders on the coating layer of UV paint, wherein the roll coater comprises a coating roll rotatably installed above the profile, which roll coats the UV paint injected from a paint injector on the profile;

a coating thickness adjustment roll installed such that a space between the coating roll and the coating thickness adjustment roll may be adjusted on the surface of coating roll according to an adjusted space; and a support roll which supports roll-wise a bottom of the profile and is installed right below the coating roll, and comprises a plurality of unit support rolls with different diameters to be inserted in one axis, and further comprising a splash prevention means positioned below the spray coater and which absorbs the metallic texture paint sprayed from the spray coater to prevent splashing of the metallic texture paint;

a scatter prevention means installed below both sides of the spray coater and which absorbs the metallic texture paint sprayed from the spray coater to prevent scattering of the metallic texture paint, a shield plate installed below the spray coater and which prevents a non-coated side of the profile from being coated with the metallic texture paint, and installed at both sides of a passage in which the profile passes through the spray coater, the shield plate is installed to have an angle of incline, a first paint receiver for receiving a UV paint flowing both sides of the support roll at a lower side of the profile, and a storage tank, positioned at the bottom of the first paint receiver, for storing UV paint recovered to the first paint receiver, wherein the splash prevention means is a tray filled with water, the scatter prevention means comprises a second paint receiver for receiving the scattered paint, and a discharge pump for sucking the paint in the second paint receiver and discharging it out of the second paint receiver.

2. The apparatus for coating a profile surface according to claim 1, further comprising a first longitudinal transport means for adjusting a longitudinal gap between the coating thickness adjustment roll and the coating roll.

3. The apparatus for coating a profile surface according to claim 1, further comprising a height adjustment means for adjusting heights of the coating roll and the coating thickness adjustment roll.

4. The apparatus for coating a profile surface according to claim 1, wherein the surface of the coating roll is made of rubber or urethane.

5. The apparatus for coating a profile surface according to claim 1, wherein at least surface of the coating thickness adjustment roll is made of metal or high hard non-metal.

6. The apparatus for coating a profile surface according to claim l, further comprising a recovery pump for allowing the UV paint in the storage tank to be introduced to the paint injector.

7. The apparatus for coating a profile surface according to claim l, further comprising a filter for filtering paint installed between the second paint receiver and the discharge pump.

8. The apparatus for coating a profile surface according to claim 1, further comprising a sensor installed at the introduction portion of the spray coater for sensing whether the profile is approached or not.

9. The apparatus for coating a profile surface according to claim 1, further comprising a curing device installed behind the spray coater for curing the metallic texture paint with which the profile is coated.

10. The apparatus for coating a profile surface according to claim 9, further comprising a take-off device, installed behind the curing device, for drawing out the completely coated profile.

* * * * *